United States Patent [19]

Holladay et al.

[11] 3,976,320

[45] Aug. 24, 1976

[54] CHICKEN COOP LIFTING DEVICE

[75] Inventors: John H. Holladay, Winterville; Albert D. Shackelford, Athens, both of Ga.

[73] Assignee: The United States of America as represented by the Secretary of Agriculture, Washington, D.C.

[22] Filed: Aug. 14, 1975

[21] Appl. No.: 604,851

[52] U.S. Cl. ..... 294/67 R; 294/113

[51] Int. Cl.[2] ..... B66C 1/16

[58] Field of Search ..... 294/67 R, 67 D, 67 B, 294/67 DB, 67 BC, 67 BA, 67 DC, 67 DA, 63 R, 81 R, 81 SF, 100, 87.22, 87.24, 106, 110, 113, 114; 224/48 A, 48 B, 48 F; 119/82

[56] References Cited

UNITED STATES PATENTS 3,193,320 7/1965 Gardner et al. ..... 294/113

3,788,694 1/1974 Hall ..... 294/67 R

FOREIGN PATENTS OR APPLICATIONS 243,685 11/1965 Germany ..... 294/67 R

*Primary Examiner*—James B. Marbert

*Attorney, Agent, or Firm*—M. Howard Silverstein; Max D. Hensley

[57] ABSTRACT

An apparatus and a process for transporting chicken coops into and out of a processing plant are disclosed. A stack of chicken coops can be lifted by the apparatus which straddles, grasps, supports, lifts, and relocates a stack or stacks into or within a poultry warehousing situation as well as out of the area, with efficiency and safety.

1 Claim, 8 Drawing Figures

FIG. 1
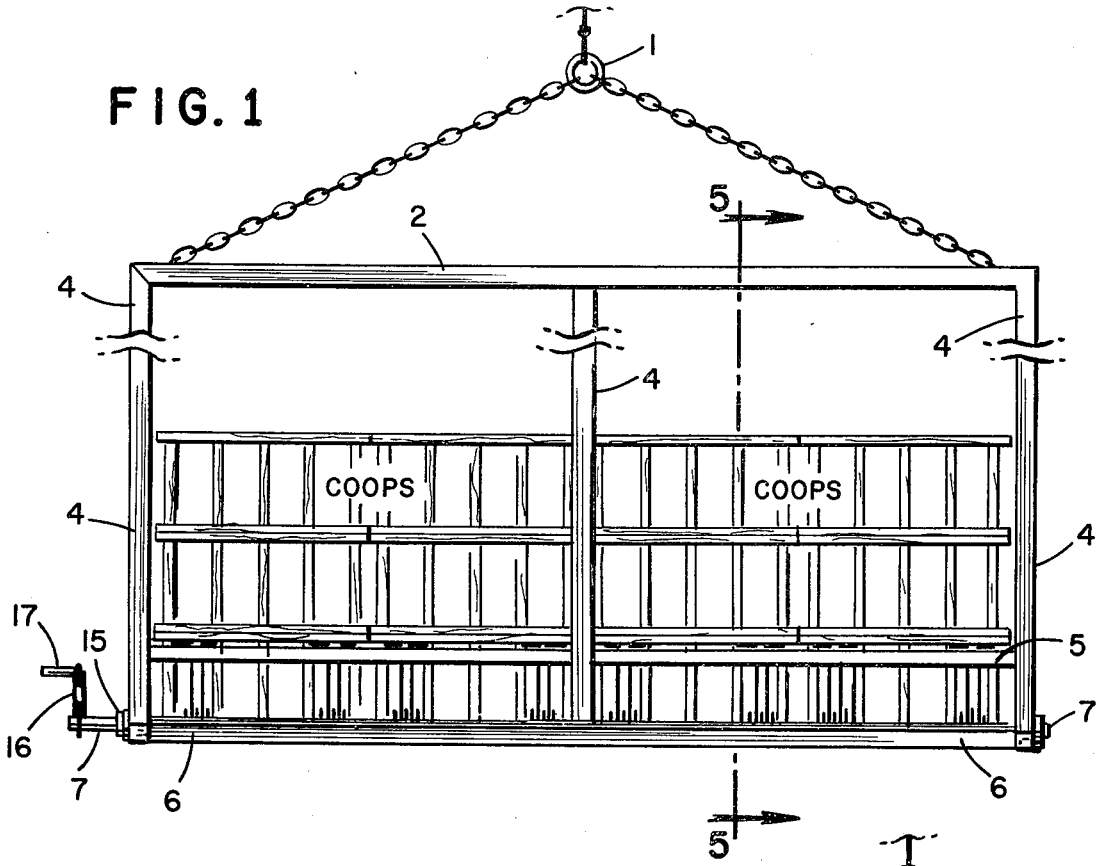
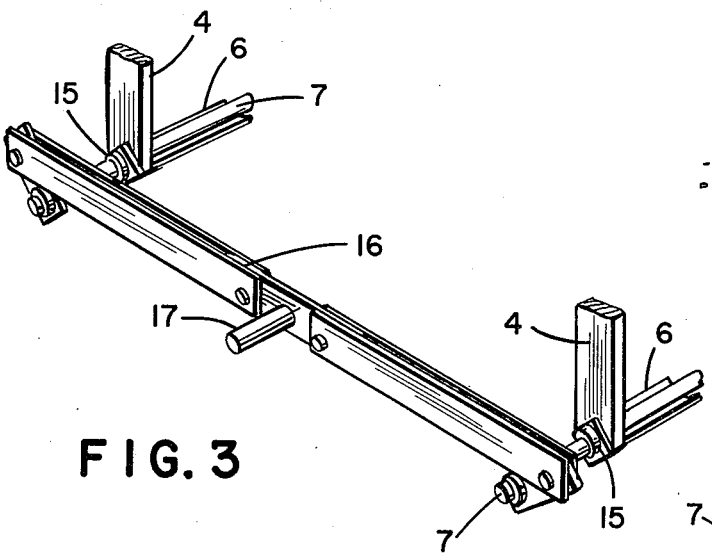
FIG. 3
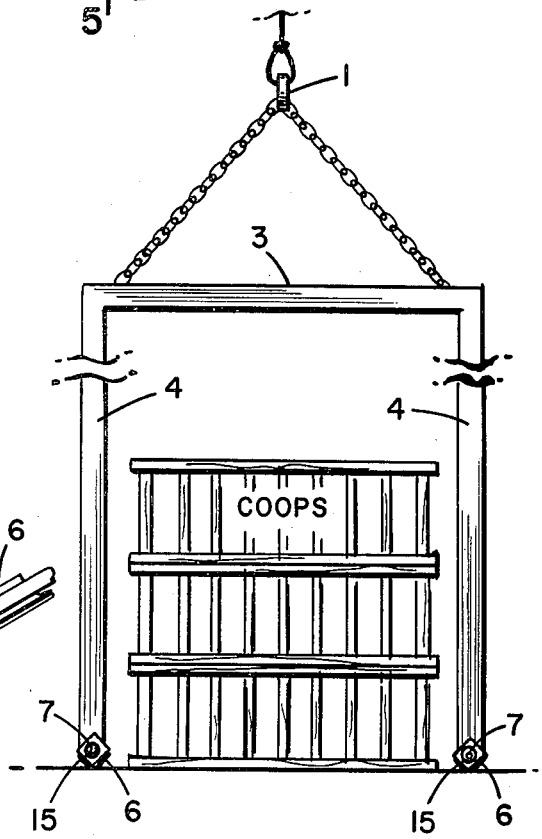
FIG. 2

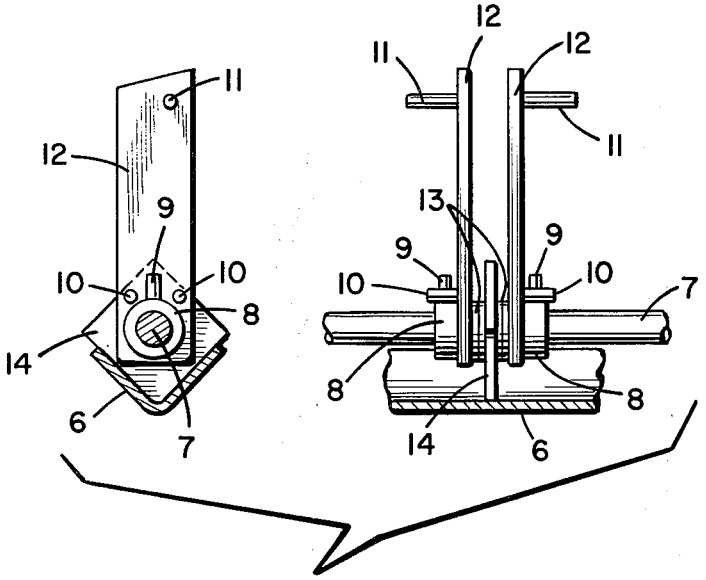
FIG. 4
FIG. 6
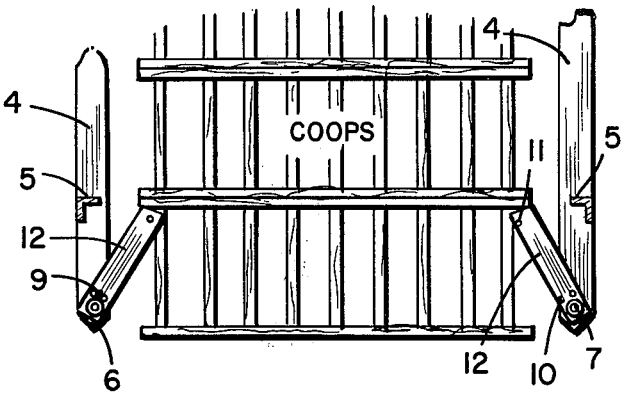
FIG. 5
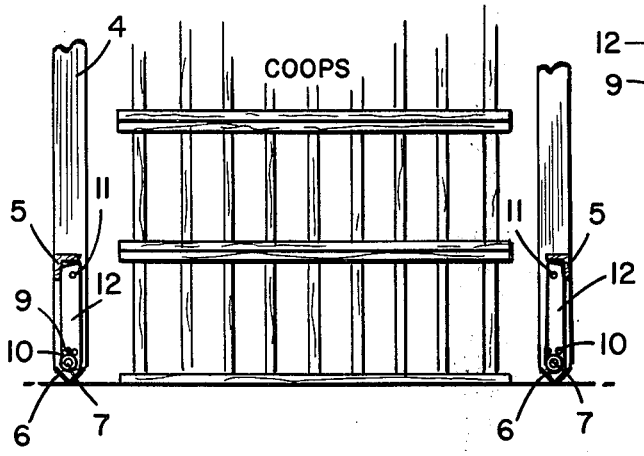
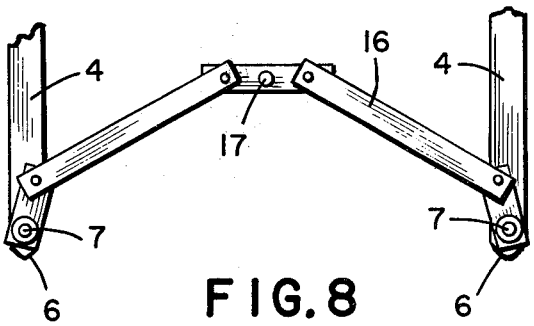
FIG. 8
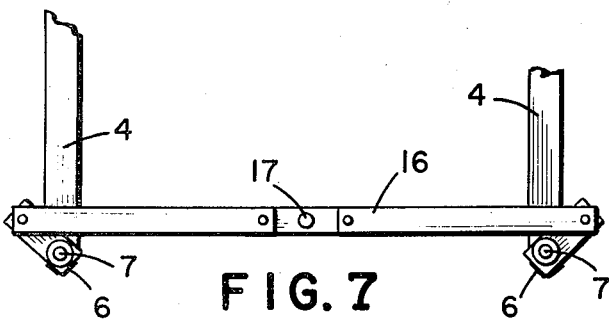
FIG. 7

CHICKEN COOP LIFTING DEVICE

This invention relates to an apparatus and to a process for mechanically handling and transporting stacks of chicken coops in a warehousing or processing plant situation. More particularly, this invention relates to an apparatus and to a process wherein chicken coops are stacked and must be moved, for example, from a live haul vehicle into a processing plant, or from a warehousing area onto the live haul vehicles.

The main object of the instant invention is to provide the poultry industry with a practical and efficient means of loading or unloading chicken coops onto or from live haul vehicles.

A second object of the instant invention is to provide a means of handling live chickens in quantity without damaging the animals or the coops in which they are transported.

In unloading live chickens from trucks and dispensing the coops in which these are transported into a processing plant customarily the coops are moved manually from the trucks and tossed onto conveyor belts, which move the 75 pound loaded coops into the processing plant. This work is very laborious and generally the task must be performed in an unsanitary atmosphere because of the presence of large quantities of fecal matter and contaminated dust. Furthermore, damage is inflicted on the poultry carcasses and to the chicken coops because of the unavoidable rough handling (of manual labor) when tossing the coops onto conveyors which transport the coops into processing plants.

Now we have discovered that damage to chickens, as well as to the coops in which they are conveyed, can be eliminated or alleviated when the stacked coops are unloaded from live haul trucks and moved into a processing plant, by utilizing the apparatus and process of the instant invention. The apparatus and process provide lower labor input, if so desired. Additional benefits can also be obtained when the invention is utilized in loading the evacuated coops back on the live haul trucks. The apparatus of the present invention can straddle, grasp, support, and dispense stacked coops whether the coops be made of wood, plastic, or metalic material.

The main component entities of the apparatus, assembled to operate in combination, comprise:

a. An outside straddle frame for straddling tiered chicken coops. This frame is provided with means for securing the assembled components to a prime mover, that is, an overhead hoist system can lift the assembled components by a chain, cable, or other lifting handle and components thereof. The straddle frame is provided with static load bearing strength.

b. A plurality of tines, generally mounted on two parallel shafts (one on each side of the straddle frame) for grasping and securing the stacked coops during a lifting operation.

c. A tine activating assembly to activate the shafts of (b) wherein an engaging and disengaging motion is effected on the lift tines which turn about the parallel shafts in order to secure the stacked coops.

To illustrate the preferred embodiment of the instant invention eight drawings are provided. These are not to be construed as limits to the invention in any manner whatever.

FIG. 1 is a side elevation view of the straddle frame.

FIG. 2 is a right end elevation view of the straddle frame.

FIG. 3 is an enlarged isometric view of the tine activating assembly on the left end of the straddle frame.

FIG. 4 is an enlarged front and side view of a lift tine mounted on (a portion of) the shaft.

FIG. 5 is a sectional elevation end view of the straddle frame showing the lift tines in a disengaged position.

FIG. 6 is the view of FIG. 5 showing the lift tines in an engaged position.

FIG. 7 is a left end elevation view of the tine activating assembly when the tines are disengaged.

FIG. 8 is the view of FIG. 7 when the tines are engaged.

The component parts of the apparatus of the instant invention, shown in FIGS. 1 through 8, are further explained and their functions emphasized whenever necessary.

OUTSIDE STRADDLE FRAME

This is the major overall component of the device. It consists of strong material members firmly connected (parts 2, 3, and 4) forming a rectangular structure (FIGS. 1 and 2). The structural members make up the top and sides of the frame, leaving the bottom and ends open. Since there are no cross members between sides (except at the top) the frame must be very rigid.

TINE ACTIVATING ASSEMBLY

This component consists of two horizontal tine shafts 7 that extend the entire length of the sides of the frame through the bottom ends of frame sections 4, and a tine activating lever assembly 16 which is attached to the ends of the two tine shafts for engaging and disengaging tines (FIGS. 7 and 8).

LIFT TINES

A number of tines are attached to the tine shaft (FIG. 1) in pairs along the sides of the straddle frame. These tines (FIG. 4) made from metal or other strong materials, are drilled and mounted on the tine shaft in pairs and so spaced that at least one of each pair will enter between the dowels of a wooden chicken coop. Coop stop in 11 falls against the coop dowel, thus preventing the tine from entering too far into the chicken coop.

UNIT OPERATION

The chicken coop lifting device operates essentially as follows:

The straddle frame is lifted above stacks of chicken coops by a hoist attached to lift chain assembly 1 or some other lifting device. It straddles one or more stacks of chicken coops that are aligned in rows such as when they are hauled on a truck. As the straddle frame is lowered over the stacks of coops, the tines are in a retracted position (FIG. 5) with tine activating lever assembly in position shown in FIG. 7. A V angle plate 6 is located on the bottom of frame members 4, housing the tine shaft 7, and the V shape on the bottom helps in guiding the frame down between stacks of coops that are not properly aligned. When the straddle frame is lowered to the level of the bottom coop to be picked up, the tine activating assembly lever 16 is moved upward by assembly handle 17 to the position shown in FIG. 8. This rotates the tine shaft 7 inward, thus engaging the tines 12 under the top of the lowest coop in stack (FIG. 6) to be moved. By lifting the straddle frame then, all the stacks above the tines can be elevated, transported, and set down again. The coops are released by disengaging movement of the tine-activating assembly (FIG. 3) upon moving the assembly handle 17 downward. Assembly handle 17 will automatically move downward when the load on tines 12 is removed by lowering the stack onto a conveyor or platform.

The chicken coop lifting device and process of this invention eliminate the toilsome labor usually performed in a dusty, sometimes unsanitary atmosphere, and prevents damage to chicken coops and to the chickens or other poultry within the coops during the unloading and loading operations.

Some novel features of this device are as follows:

1. A series of lift tines 12 which maintains positive control on stacks of coops for elevating and transporting operations, thus increasing the productivity of the operation over other means of handling coops.

2. The lift tines 12 act independently of each other in the engaging position to compensate for misaligned coops and/or straddle frame alignment.

3. Automatic disengaging of the lift tines 12 when the stacks of coops are set on a conveyor or on a surface such as a floor or truck bed.

ENUMERATION OF PARTS OF THE CHICKEN COOP LIFTING DEVICE

1. Lift Chain Assembly
2. Top Side Frame Members
3. Top Cross Frame Members
4. Straddle Frame Arms
5. Lift Tine Stop
6. Angle Plate
7. Tine Shaft
8. Lock Collar 9. Tine Activating Pin
10. Tine Positioning Pins
11. Coop Stop Pin
12. Lift Tine
13. Spacers
14. Shaft Bracket
15. Set Collar
16. Tine Activating Lever Assembly
17. Tine Activating Assembly Handle

We claim:

1. An apparatus for elevating and transporting a plurality of stacks of poultry coops by mechanical means with minimal manual labor, the apparatus consisting of the following components assembled to operate as a unit:

a. A load-bearing frame comprising a plurality of vertical and horizontal members attached to each other to form substantially a rectangular table-like structure having two parallel rows of legs to straddle a plurality of stacks of poultry coops when said coops are stacked one coop in depth and more than one coop in height and width, b. a plurality of lift tines for grasping, positioning, and securing the stacks of coops during the elevating and transporting operations, said tines being actuated by an pivoting about a tine shaft to which each of two rows of tines is secured, one row of tines being on each shaft, c. a tine-activating assembly secured to the load bearing frame at one end to provide automatic disengagement of the lift tines to free all coops at the end of each transporting operation, and d. a means of lifting the load bearing frame when fully loaded.

* * * * *